US009636274B2

(12) United States Patent
Monti

(10) Patent No.: US 9,636,274 B2
(45) Date of Patent: May 2, 2017

(54) DEVICE FOR TRANSFERRING PHARMACEUTICAL ARTICLES FROM A COUNTER TO INSIDE CONTINUOUSLY ADVANCING CONTAINERS AND A MACHINE FOR PACKING PHARMACEUTICAL ARTICLES IN RELATIVE CONTAINERS

(71) Applicant: Marchesini Group S.p.A, Pianoro, Bologna (IT)

(72) Inventor: Giuseppe Monti, Pianoro Bologna (IT)

(73) Assignee: MARCHESINI GROUP S.P.A., Pianoro, Bologna (IT)

( * ) Notice: Subject to any disclaimer, the term of this patent is extended or adjusted under 35 U.S.C. 154(b) by 802 days.

(21) Appl. No.: 13/909,432

(22) Filed: Jun. 4, 2013

(65) Prior Publication Data

US 2013/0318913 A1 Dec. 5, 2013

(30) Foreign Application Priority Data

Jun. 5, 2012 (IT) ..... BO2012A0304

(51) Int. Cl.
*A61J 1/03* (2006.01)
*B65B 5/10* (2006.01)
(Continued)

(52) U.S. Cl.
CPC ..... *A61J 1/03* (2013.01); *B65B 5/103* (2013.01); *B65B 39/145* (2013.01); *B65B 57/20* (2013.01)

(58) Field of Classification Search
CPC B65B 1/06; B65B 5/103; B65B 35/32; B65B 39/007
(Continued)

(56) References Cited

U.S. PATENT DOCUMENTS 3,028,713 A 4/1962 Kennedy et al.
3,064,406 A 11/1962 Kennedy et al.
(Continued)

FOREIGN PATENT DOCUMENTS

GB 983885 A * 2/1965 ..... B65B 61/22
WO WO 2011/028103 A1 3/2011

*Primary Examiner* — Thanh Truong
*Assistant Examiner* — Patrick Fry
(74) *Attorney, Agent, or Firm* — R. Neil Sudol; Henry D. Coleman

(57) ABSTRACT

The device (D) for transferring pharmaceutical articles from a counter to inside containers (C), continuously advancing along an advancement direction (V), comprises a first series of tubular elements (T1) and a second series of tubular elements (T2) having dimensions such as to be able to freely receive the pharmaceutical articles internally thereof. The first series of tubular elements (T1) and the second series of tubular elements (T2) are movable independently of one another along respective pathways that each exhibit a development such that each of the tubular elements (T1) of the first series and each of the tubular elements (T2) of the second series can transit below and at the outlet (U) of the counter (MC) such as to receive the counted articles, and further can transit above the mouth of a respective container (C) advancing continuously along the advancement direction (V) and follow the advancement of the container (C) while remaining above the relative mouth for a straight tract (V1) along the direction (V), so as to release the articles internally thereof.

4 Claims, 8 Drawing Sheets

(51) Int. Cl.
*B65B 39/14* (2006.01)
*B65B 57/20* (2006.01)

(58) Field of Classification Search
USPC ..... 53/147
See application file for complete search history.

(56) References Cited

U.S. PATENT DOCUMENTS 3,643,586 A * 2/1972 Robinson ..... A23L 3/02 53/510
3,925,960 A 12/1975 Saari et al.
4,511,027 A * 4/1985 Zamboni ..... B67C 7/0006 198/470.1
4,818,908 A * 4/1989 Tamae ..... H02K 29/06 310/171
5,257,888 A * 11/1993 Kronseder ..... B65G 47/904 294/65
5,375,395 A * 12/1994 Gmeiner ..... B65B 21/04 53/247
5,713,180 A * 2/1998 Lewis ..... B65B 43/50 53/249
5,762,116 A * 6/1998 Moore ..... B65B 5/103 141/145
5,838,121 A * 11/1998 Fairbairn ..... H01L 21/67742 318/45
6,354,427 B1 * 3/2002 Pickel ..... A23L 3/001 198/470.1
7,077,619 B2 * 7/2006 Corrigan ..... B65G 47/846 414/744.4
2013/0061560 A1 * 3/2013 Gertitschke ..... B65B 61/22 53/438

* cited by examiner

DEVICE FOR TRANSFERRING PHARMACEUTICAL ARTICLES FROM A COUNTER TO INSIDE CONTINUOUSLY ADVANCING CONTAINERS AND A MACHINE FOR PACKING PHARMACEUTICAL ARTICLES IN RELATIVE CONTAINERS

FIELD OF THE INVENTION

The present invention relates to the technical sector of packaging of pharmaceutical articles, such as for example tablets, capsules, pills and the like, internally of relative containers, such as for example bottles, vials, small jars, etc.

In particular, the present invention relates to a device for transferring the pharmaceutical articles, once counted in the exact number to be inserted in the containers, by a counting apparatus internally of containers advancing in a continuous motion.

The present invention further relates to a machine for packing pharmaceutical articles in relative containers in which the above-mentioned device is predisposed and used.

DESCRIPTION OF THE PRIOR ART

In the technical sector of interest, i.e. packing pharmaceutical articles internally of relative containers, there is a known need to perform the insertion of the articles into the containers in the exact required and predetermined number.

Further, at the same time there is a need to insert perfectly whole articles, as regards the size and shape thereof, into the containers.

For this purpose counting apparatus are known, which carry out the control of the wholeness of the articles and the counting thereof.

These counting apparatus therefore make available the required number of articles at their outlet once the operations of verifying and counting have been completed.

These usually include a series of storage conduits of the articles into each whereof, in sequence, the articles recognized as valid and counted are directed.

Once one of these conduits has been filled with the requested number of articles recognized as whole, these articles are unloaded and conveyed towards the outlet of the counter where a hatch, once open, proceeds to the releasing of the articles.

As at present it is not possible to know a priori which and how many of the articles that are sent to the counting apparatus are whole, or not, the time interval between the completion of a count of the exact number of whole articles requested and the next is never constant.

Consequently the unloading of the whole articles, counted to the requested number by the outlet of the counter cannot always occur with a same time frequency.

At present the containers to be filled are made to transit below the outlet of the counter and stopped once situated at the outlet in order to be filled.

In a first known mode the conveyor used for advancing the containers is step-activated such as to position, for each activating step, a container at a time below the outlet of the counter and to wait for the required number of articles to be ready.

It is clear that this mode is not at all advantageous in terms of productivity as the number of filled containers per minute is very very low.

In a further known mode, the containers are positioned on a conveyor which is advanced continuously and transits the container below the outlet of the counter and use is made of a sort of gate or mobile element which is activated and translated transversally to the conveyor in order to stop the container to be filled, and ten also those the ones behind it, below the outlet of the counter for the time necessary to fill it.

With respect to the preceding, this solution enables an increase in productivity but not significantly.

Further, recourse to an advancement stop and block of the containers can lead to problems as they might subjected to impacts by the element or even by reciprocal impacts as the containers situated upstream of the one which is stopped are pushed ahead by the conveyor.

SUMMARY OF THE INVENTION

The aim of the present invention is to provide a device for transferring pharmaceutical articles from a counter internally of containers advancing continuously able to obviate the above-mentioned drawbacks present in the prior art.

In particular, an aim of the present invention is to provide a device able to perform transfer of the pharmaceutical articles, enabling maintaining of a continuous advancement and effecting the transfer rapidly and efficiently, guaranteeing the obtaining of very much higher productivity standards than the prior art.

The mentioned aims are attained according to a device for transferring pharmaceutical articles in relative containers according to claim 1.

Other advantageous characteristics of the device of the present invention are set out in the various claims dependent on claim 1.

A further aim of the present aim is also to provide a machine for packing pharmaceutical articles in relative container which exhibits a compact shape in a single-block structure which comprises and uses the above-mentioned device for effecting the transfer and inserting of articles in the containers.

BRIEF DESCRIPTION OF THE DRAWINGS

The characteristics of the device for transfer of pharmaceutical articles from a counter internally of continuously advancing containers and the machine for the packing of pharmaceutical articles in relative containers disclosed by the present invention are described in the following with reference to the accompanying tables of drawings, in which:

FIG. 7 is a view from above of the device of FIG. 6, while

DESCRIPTION OF PREFERRED EMBODIMENTS

With reference to the accompanying tables of drawings, and in particular to figures from 1 to 8, reference (D) denotes the device for transferring pharmaceutical articles from a counter to inside relative continuously advancing containers, object of the present invention, in its entirety.

The counter (MC), in known ways, exhibits a storage zone (Z) in which the articles are directed, once they have been counted and validated as whole by suitable detecting and counting means present in the counter (MC).

The storage zone (Z) is provided with an outlet (U) for the articles, openable for release of the articles in a downwards direction, and which outlet (U) is arranged laterally and in a position at an elevated level with respect to the containers (C) which are to be filled with the counted and whole articles advancing continuously along an advancement direction (V).

The device (D) comprises a first series of tubular elements (T1) having dimensions such as to be able to freely receive the pharmaceutical articles internally thereof, and a second series of tubular elements (T2) having dimensions such as to be able to freely receive the pharmaceutical articles internally thereof.

Figure 1:
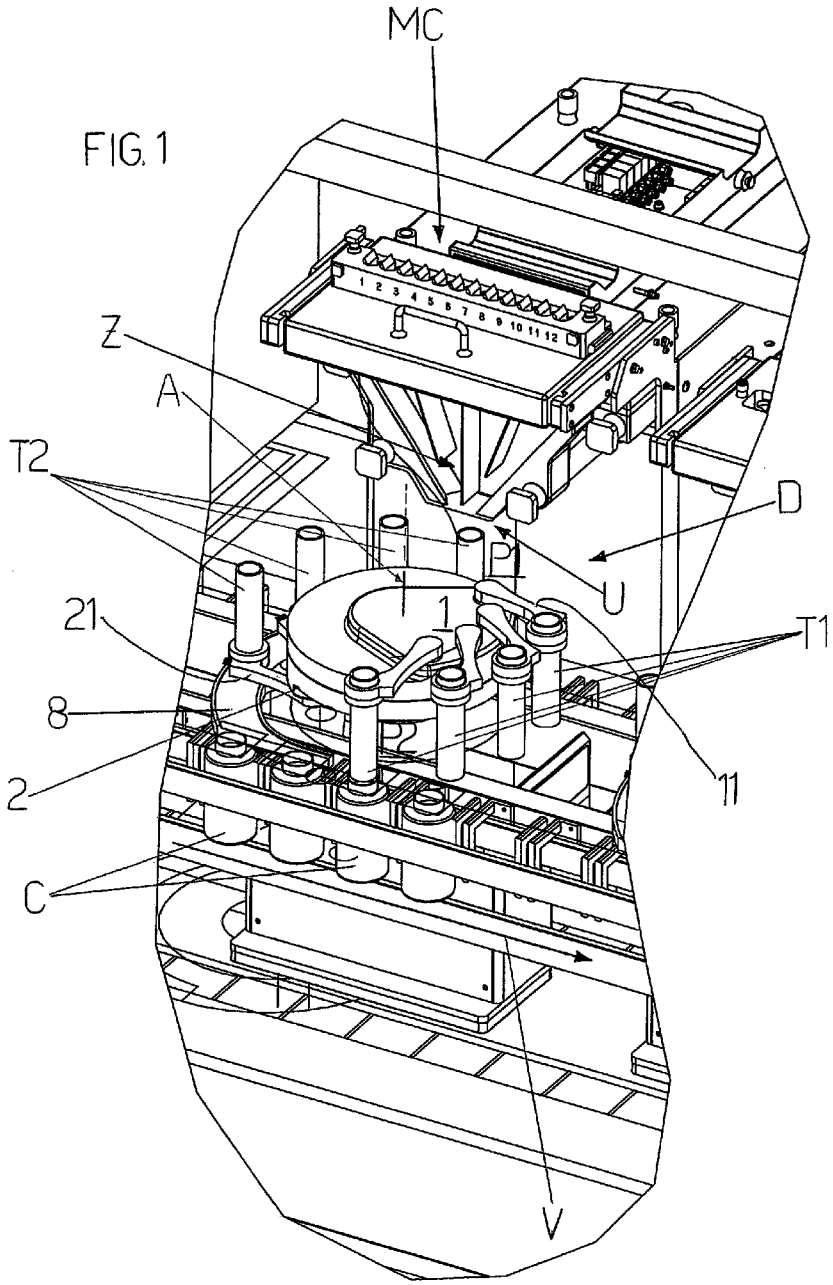
FIG. 1 is a schematic perspective view of the device of the invention, in a preferred embodiment, situated in a position between the outlet of a counter and an advancement line of the containers along which the containers are advanced continuously, FIG. 2 schematically illustrates a plan view of the device of FIG. 1 in a particular operating step of the functioning thereof.

The tubular elements (T1) of the first series and the tubular elements (T2) of the second series are predisposed in such a way as to be arranged vertically so that respective upper ends thereof are situated at a lower level than the outlet level (U) of the counter (MC) and respective lower ends thereof are situated at a higher level than the mouths of the containers (C) continuously advancing along the advancement direction (V) (see for example FIG. 1).

A peculiarity of the device (D) consists in the fact that the first series of tubular elements (T1) and the second series of tubular elements (T2) are movable independently of one another in rotation about a common rotation axis (A).

Figure 2:
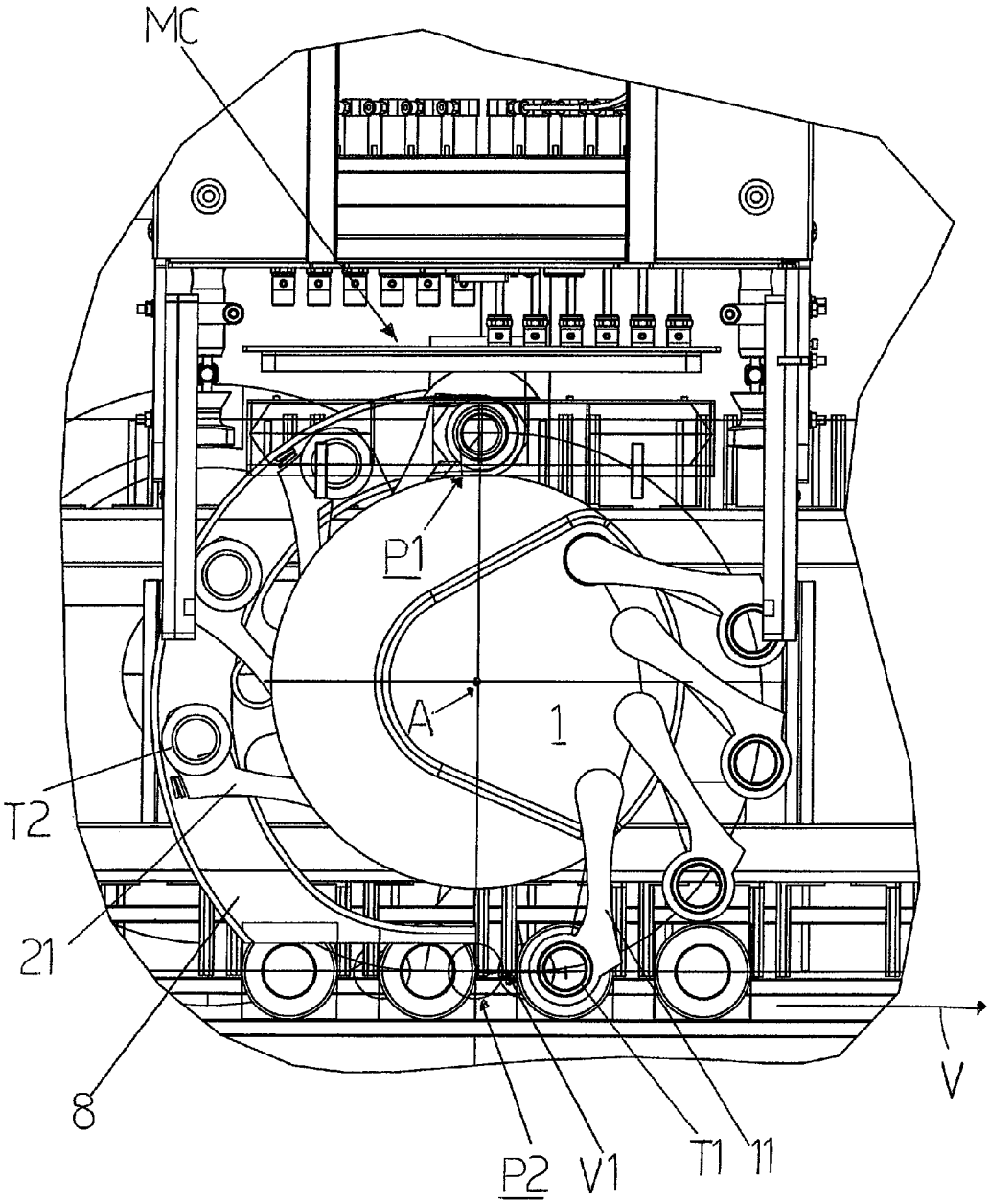

More specifically, the tubular elements (T1) of the first series and the tubular elements (T2) of the second series are movable in a same rotation direction (R) according to respective pathways which each exhibit a development such that:

each of the tubular elements (T1) of the first series of tubular elements can transit below and at the outlet (U) of the counter (MC) and can also transit above the mouth of a respective container (C) advancing continuously along the advancement direction (V) and follow the advancement of the container (C) while remaining above the relative mouth for a straight tract (V1) along the direction (V), and such that each of the tubular elements (T2) of the second series of tubular elements can transit below and at the outlet (U) of the counter (MC) and further can transit above the mouth of a respective container (C) advancing continuously along the advancement direction (V) and follow the advancement of the container (C) while remaining above the relative mouth thereof for a straight tract (V1) along the direction (V) (see for example in detail FIG. 2 and also FIG. 3).

A further peculiarity of the device (D) of the present invention consists in the fact that the first series of tubular elements (T1) is movable in rotation about the rotation axis (A) with a stepped rotation mode such that for each stepped motion a relative tubular element can be positioned time by time paused in a position (P1) below the outlet (U) of the counter (MC) such as to be able to receive the pharmaceutical articles counted by the counter (MC), and further is movable, once all the tubular elements have received the corresponding number of counted articles, in rotation about the rotation axis (A) with a continuous mode with a rotation velocity such that each of the tubular elements (T1) with the counted articles internally thereof can reach and be positioned in a position (P2) above the mouth of a corresponding container (C) advancing along the advancement direction (V) and follow the container (C) with a same advancement velocity along the straight tract (V1) such as to be able to release the articles internally thereof.

Correspondingly, the device (D) comprises that also the second series of tubular elements (T2) is movable in rotation about the rotation axis (A) with a stepped rotation mode such that for each stepped motion a relative tubular element can be positioned time by time paused in a position (P1) below the outlet (U) of the counter (MC) such as to be able to receive the pharmaceutical articles counted by the counter (MC), and further is movable, once all the tubular elements have received the corresponding number of counted articles, in rotation about the rotation axis (A) with a continuous mode with a rotation velocity such that each of the tubular elements (T2) with the counted articles internally thereof can reach and be positioned in a position (P2) above the mouth of a corresponding container (C) advancing along the advancement direction (V) and follow the container (C) with a same advancement velocity along the straight tract (V1) such as to be able to release the articles internally thereof.

The device (D) is specially predisposed such that when the first series of tubular elements (T1) is moved in rotation with the stepped mode, such that the relative tubular elements (T1) can be positioned time by time below the outlet (U) of the counter (MC) and receive therefrom the counted articles, the second series of tubular elements (T2) is moved in rotation with the continuous mode such that the relative tubular elements (T2) can unload the articles into the containers (C), and vice versa.

The device (D) further comprises a support plate (8) which exhibits a curved development and an extension corresponding to the pathway followed by the tubular elements (T1, T2) from the outlet (U) of the counter (MC) up to the start of the above-cited straight tract (V1).

The plate (8) is arranged in such a way as to be positioned at such a level that the lower ends of the tubular elements (T1, T2), once the articles have been received from the outlet of the counter, when moved along the relative tracts of pathway from the outlet (U) of the counter (MC) up to above the containers (C), can slide in contact with the plate (8) such that the articles present therein are retained internally thereof up to when the tubular elements (T1, T2) have reached and are positioned above the mouth of the containers at the start of the straight tract (V1).

Owing to the presence of the two series of tubular elements (T1, T2), to the fact that the two series of tubular elements (T1, T2) are activatable independently one from the other, and to the fact that each of the two series of tubular elements (T1, T2) can be activated in rotation both with a stepped rotation mode and a continuous rotation mode, the device (D) is able to carry out the transfer of articles from a counter, which makes available the counted articles in time intervals that are not a priori predeterminable, in container with are advanced continuously along an advancement direction.

In fact, while the tubular elements (T1) of the first series are activated in rotation with the stepped rotation mode, such as to be positioned time by time below the outlet (U) of the counter (MC) in order to be filled with the counted articles, the tubular elements (T2) of the second series (filled previously) can be activated in rotation with the continuous rotation mode and at a velocity such as to position each, one after another, above a relative container (C) and follow it for a straight tract (V1) during the advancement thereof such as to be able to unload therein the articles previously received by the counter.

This situation is inverted when it is the tubular elements (T2) of the second series which are activated with the stepped rotation mode in order to be positioned time by time below the outlet (U) of the counter while the tubular elements (T1) of the first series are activated with the continuous rotation modes and with a velocity that is such as each to be positioned, one after another, above a relative container (C) and in order to follow it over a straight tract (V1) during the advancement thereof such as to be able to unload the articles previously received from the counter into the container.

In this way, thanks to the device of the present invention, the advancing of the containers can be freed up, and the containers can thus be advanced continuously without any stopping or pause, from the modes and times required by the counter in order to provide the exact number of whole articles at the outlet thereof.

Each single tubular element of the first and second series of tubular elements (T1, T2) will thus perform the following operations and movements.

In order to be loaded with the articles counted by the counter, it will first be activated in rotation with the stepped rotation mode up to when, at a rotating activating step, it will be positioned in pause below the outlet of the counter.

Once the counter has counted the requested number of whole articles and these articles have been directed into the storage zone (Z) at the outlet (U), the outlet is opened and the articles can drop into the tubular element paused below it.

The dropped articles are held in the tubular element thanks to the presence below them of the plate (8).

Once the tubular element has received the counted articles, the tubular element, together with the other tubular elements of the same series, is activated in rotation by a further step in order that another tubular element of the series is positioned below the outlet of the counter.

These operations are repeated up to when all the tubular elements of the same series of tubular elements have been filled with the counted articles.

As soon as the final tubular element of the series has received the articles counted by the counter, all the tubular elements of the series will be activated in rotation with the continuous rotation mode and at a rotation velocity that is such that each, one after another, can reach and be positioned above a relative container (C) and follow it for a straight tract (V1) during the advancement thereof in order to be able to unload the articles previously received from the counter into the container.

Other characteristics of the device (D) of the present invention are set out in the following.

Figure 4:
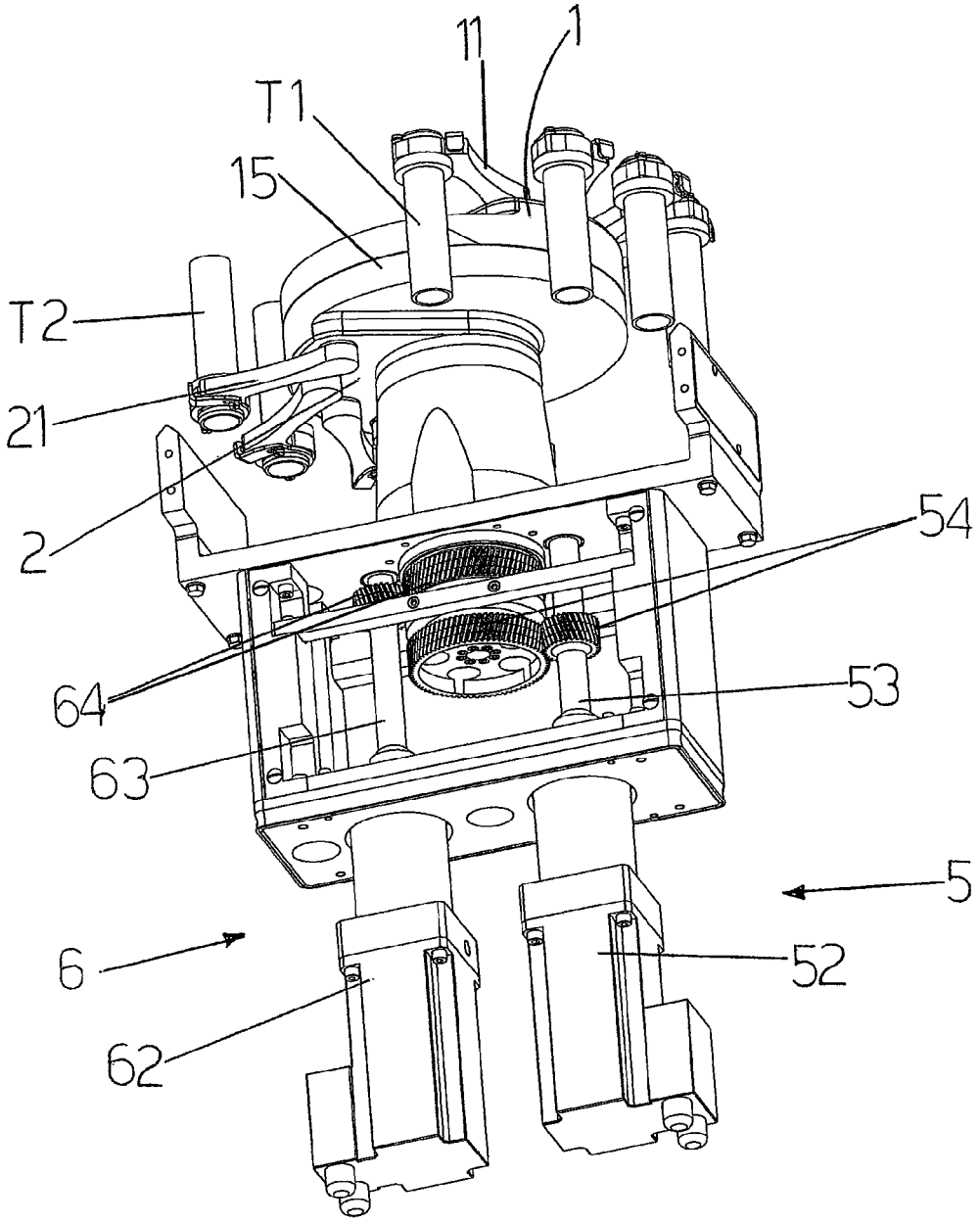
FIG. 4 is a schematic perspective view from below of the present invention, as in FIG. 1, for better illustrating some of the significant parts.

The device (D) comprises a first support organ (1) for the first series of tubular elements (T1) and a second support organ (2) for the second series of tubular elements (T2), the tubular elements (T1) of the first series being borne by respective support arms (11) each of which is pivoted to the first support organ (1) in such a way as to be able to rotate with respect thereto about a vertical axis and in such a way as to maintain the tubular elements (T1) in a vertical position, and the tubular elements (T2) of the second series being borne by respective support arms (21) each of which is pivoted to the second support organ (2) such as to be able to rotate with respect thereto about a vertical axis and such as to maintain the tubular elements (T2) in a vertical position (see for example FIGS. 1, 4).

The first support organ (1) and the second support organ (2) are arranged reciprocally coaxially and are rotatable about the common rotation axis (A) and activatable in rotation with respect to the rotation axis (A) independently of one another according to the stepped and continuous activating modes.

Figure 3:
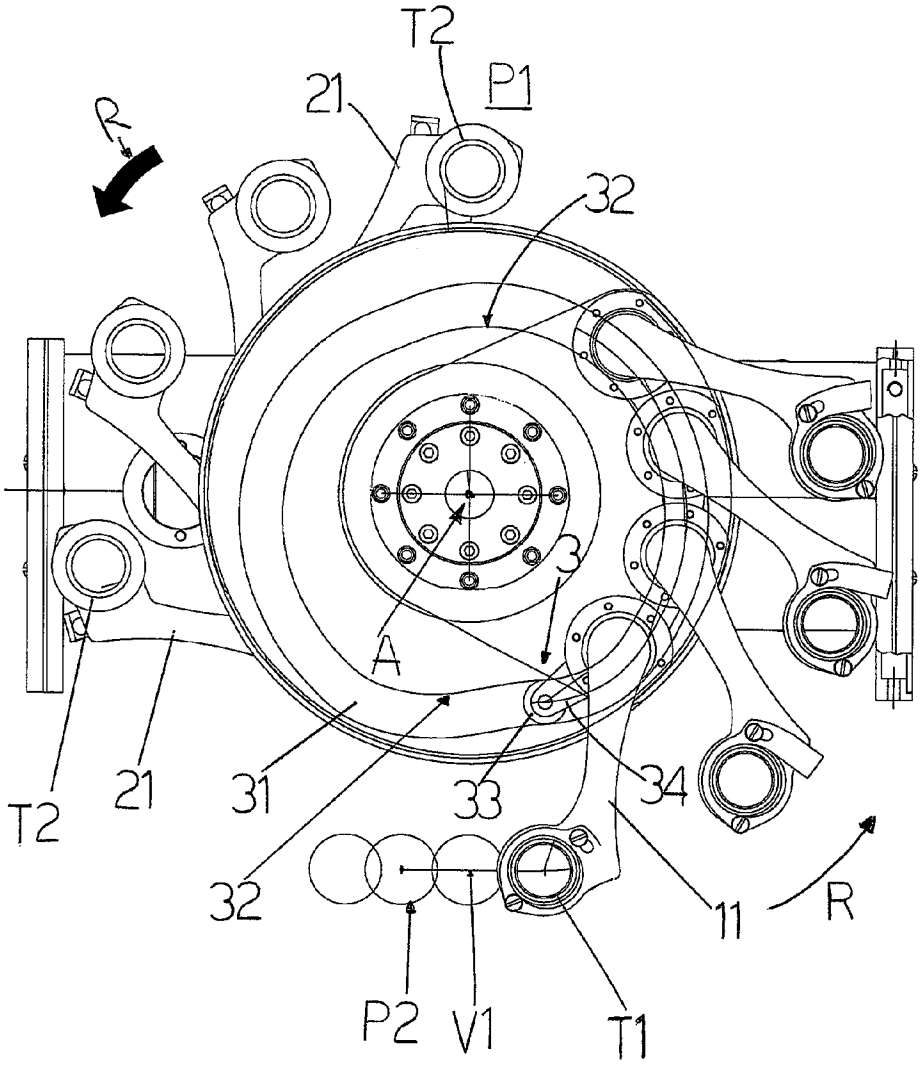
FIG. 3 is a schematic plan view of the device of the invention of FIG. 1, in which some parts have been omitted better to evidence other significant components of the proposed device.
Figure 5:
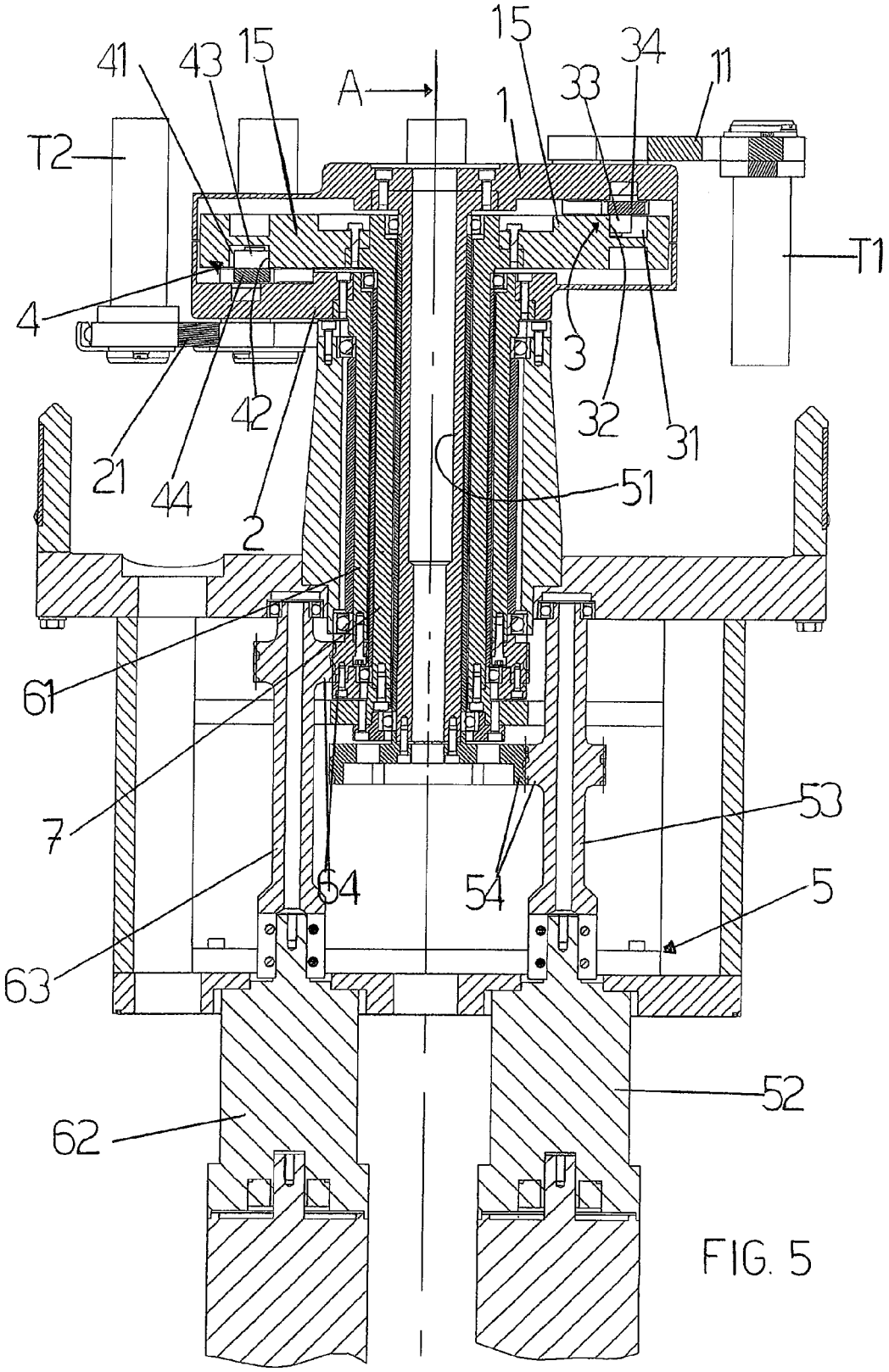
FIG. 5 is a transversal and vertical section view of the device of the invention as in FIG. 1.
Figure 6:
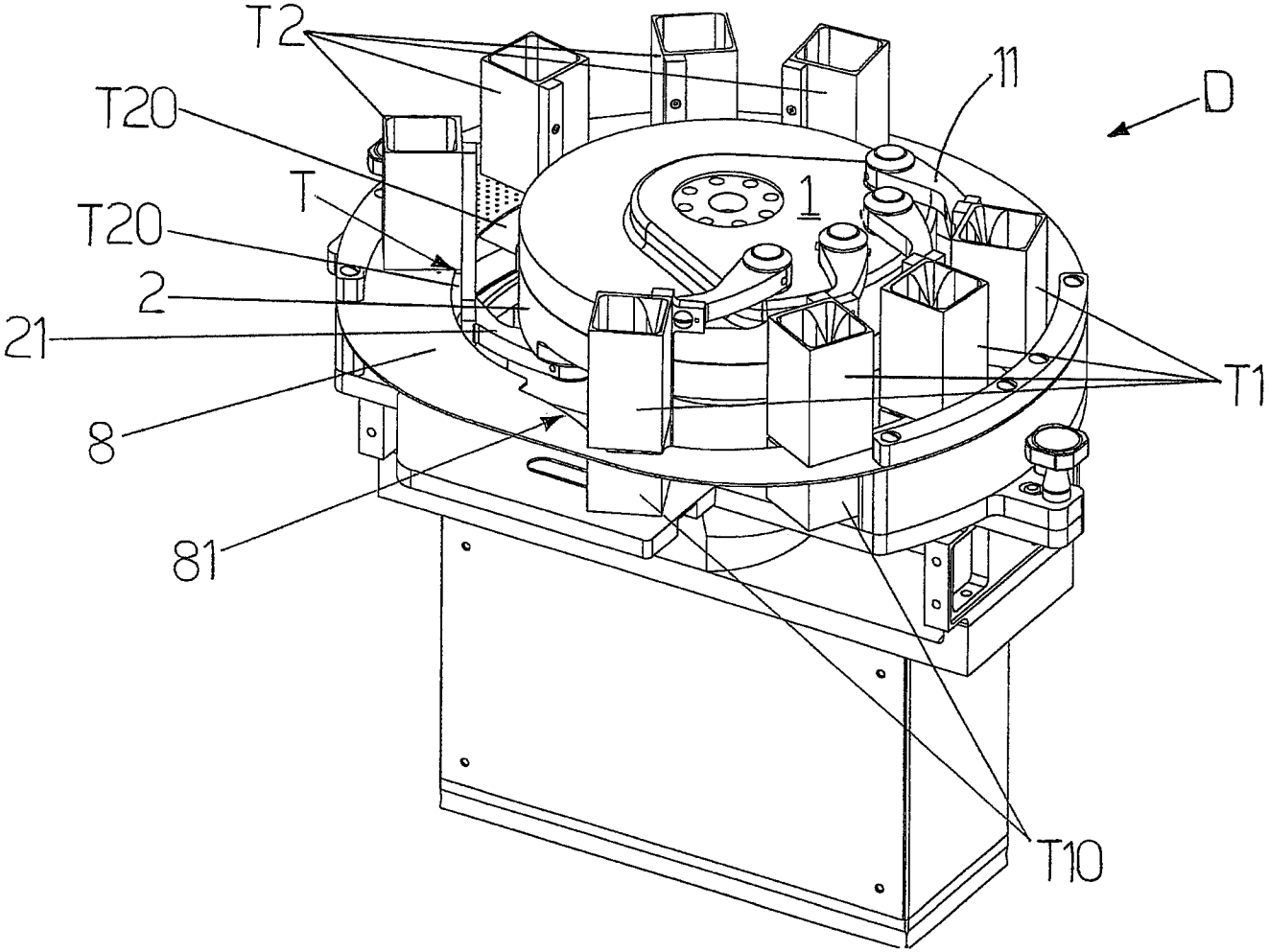
FIG. 6 is a perspective view of the device of the invention in a further possible advantageous embodiment, also usable in a position between the outlet of a counter and an advancement line of the containers along which the containers are advanced continuously, as in the case of the device of FIG. 1.
Figure 8:
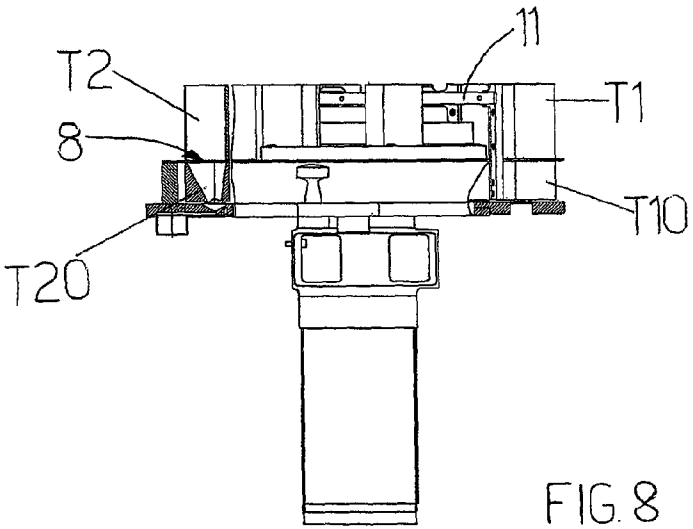
FIG. 8 is a transversal and vertical section view of the device of FIG. 7.
Figure 7:
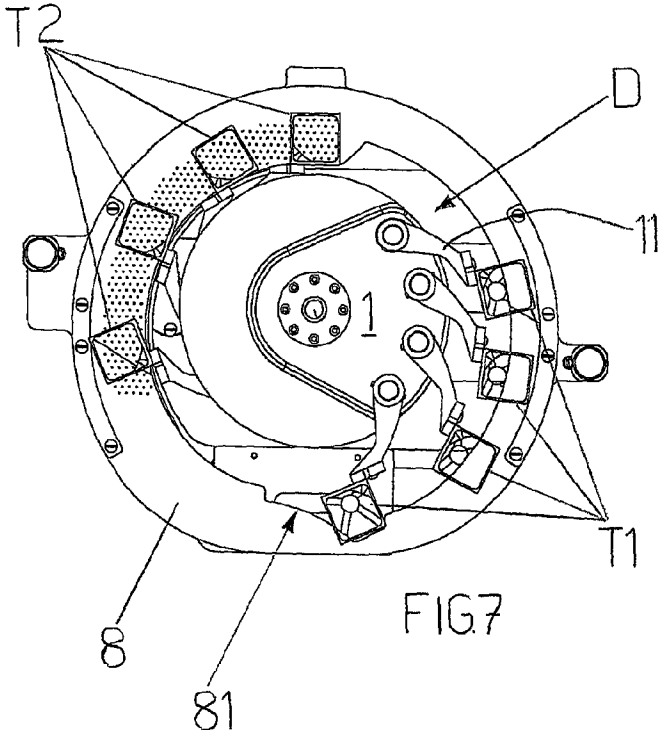
Figure 9:
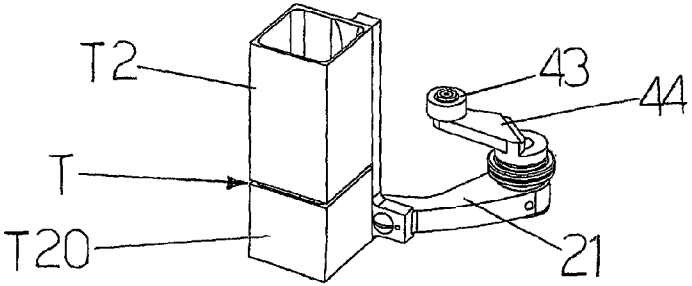
FIG. 9 is a schematic perspective view of particularly important components of the device illustrated in figures from 6 to 8.

The device (D) comprises first correcting means (3) of the position of the support arms (11) of the tubular elements (T1) of the first series of tubular elements with respect to the first support organ (1) (visible for example in FIG. 3 and FIG. 5).

The first correcting means (3) of the position of the support arms (11) are configured and predisposed with respect to the first support organ (1) in such a way that consequently to the activation in rotation of the first support organ (1) about the rotation axis (A), each of the tubular elements (T1) of the first series of tubular elements, during advancement along the rotation pathway thereof about the rotation axis (A), can be positioned in the position (P1) below and at the outlet (U) of the counter (MC) and further can be positioned in the position (P2) above the mouth of a respective container (C) advancing continuously along the advancement direction (V) and follow the advancement of the container (C) while remaining above the relative mouth for the straight tract (V1) along the direction (V).

The device (D) further comprises second correcting means (4) of the position of the support arms (21) of the tubular elements (T2) of the second series of tubular elements with respect to the second support organ (2) (visible for example in FIG. 5).

The second correcting means (4) of the position of the support arms (21) are configured and predisposed with respect to the second support organ (2) such that consequently to the activating in rotation of the second support organ (2) about the rotation axis (A), each of the tubular elements (T2) of the second series of tubular elements, during the advancement along the rotation pathway about the rotation axis (A), can be positioned in the position (P1) below and at the outlet (U) of the counter (MC) and further can be positioned in the position (P2) above the mouth of a respective container (C) in continuous advancement along the advancement direction (V) and follow the advancement of the container (C) remaining above the relative mouth for the straight tract (V1) along the direction (V).

The device (D) further comprises a fixed element (15) which is mounted such as to be positioned interposed between the first support organ (1) and the second support organ (2).

In particular, the first correcting means (3) of the position of the support arms (11) of the tubular elements (T1) of the first series of tubular elements comprise a groove (31) present in the part of the fixed element (15) facing towards the first support organ (1), the groove (31) extending in a closed loop and defining a first cam pathway (32) (visible for example clearly in FIG. 3).

The first means (3) also comprise, for each of the support arms (11), a wheel (33) situated internally of the groove (31) and having such a shape as to be able to run therein and follow the route of the first cam pathway (32), and a rocker arm (34) mounted at an end thereof on the wheel (33) and fixed at the other end rigidly to the support arm (11) (also visible in FIG. 3 and FIG. 5).

In this way the support arms (11) of the tubular elements (T1) of the first series of tubular elements are set in rotation about the rotation axis (A) following the rotation of the support organ (1) and, by means of the rigid connection thereof to the rocker (34), are such that the wheel (33) runs in the groove (31) following the first cam pathway (32).

The groove (31) is realized in the part of the fixed element (15) facing towards the first support organ (1) such that the route of the first cam pathway (32) is such that each of the tubular elements (T1) of the first series, during the advancing along the rotation pathway about the rotation axis (A), can be positioned in the position (P1) below and at the outlet (U) of the counter (MC) and can be positioned in the position (P2) above the mouth of a container (C) advancing along the advancement direction (V) and can follow it, remaining aligned to the mouth for the straight tract (V1) of advancement along the advancement direction.

In practice, the wheel (33) running in the groove (31) is forced to follow the first cam pathway (32) which forces it to take on various positions with respect to the rotation axis (A), which determines, via the rocker arm (34), also the changing of the orientation of the support arms (11), and therefore of the tubular elements (T1) with respect to the support organs (1).

In this regard, the first cam pathway (32) will include a tract the route of which is designed such that the support arms (11) will be forced to take on a position which leads them to maintain the tubular elements (T1) aligned above the container (C) along the straight tract (V1) during the advancing of the containers along the advancement direction (V).

The second correcting means (4) of the position of the support arms (21) of the tubular elements (T2) of the second series of tubular elements comprise a groove (41) present in the part of the fixed element (15) facing towards the second support organ (2), the groove (41) extending in a closed loop and defining a second cam pathway (42) (a wall of which can be seen in the section of FIG. 5).

The second means (4) further comprise, for each of the support arms (21), a wheel (43) situated internally of the groove (41) and having such a shape as to be able to run therein and follow the route of the second cam pathway (42), and a rocker arm (44) mounted at an end thereof on the wheel (43) and fixed at the other end rigidly to the support arm (21).

The groove (41) is realized in the part of the fixed element (15) facing towards the second support organ (2) such that the route of the second cam pathway (42) is such that each of the tubular elements (T2) of the second series, during the advancing along the rotation pathway about the rotation axis (A), can be positioned in the position (P1) below and at the outlet (U) of the counter (MC) and can be positioned in the position (P2) above the mouth of a container (C) advancing along the advancement direction (V) and can follow it, remaining aligned to the mouth for the straight tract (V1) of advancement along the advancement direction.

The same considerations made above the route of the first cam pathway (32) and the consequent movement of the support arms (11) of the tubular elements (T1) of the first series of tubular elements are the same for the route of the second cam pathway (42) and the consequent movement of the support arms (21) of the tubular elements of the second series of tubular elements.

The device (D) of the preferred embodiment illustrated in figures from 1 to 5 is provided with tubular elements (T1, T2) which exhibit a tubular cylindrical shape, i.e. tubular elements (T1, T2) with a circular transversal section. The circular section of the tubular elements (T1, T2) must correspond to the dimensions of the mouth of the container (C) which must be filled with the articles released by the tubular elements (T1, T2) when each of them reaches the start of the straight tract (V1) and has passed beyond the end of the plate (8).

In this way, when each tubular element (T1, T2) follows the container (C) to be filled along the straight tract (V1), along which straight tract (V1), as previously mentioned more than once, the tubular element (T1, T2) follows the container (C) with the same advancement velocity as the container (C), the tubular element (T1, T2) will be centered with the mouth of the container (C) such that the articles present therein can fall into the container (C) itself.

The plate (8) is then arranged and positioned in such a way that the terminal end is arranged at the start of the straight tract (V1) and at a height such that it is in a raised position, and with a minimum height different with respect to the height of the mouth of the containers (C) which arrive at the start of the straight tract (V1). Consequently, the tubular elements (T1, T2) are mounted on relative support arms (11, 21) and exhibit a height such that once having passed beyond the end of the plate (8) the lower end thereof is in a position immediately above the mouth of the containers (C).

In this embodiment of the device (D), in a case where the container to be filled change format, i.e. there is the need to fill containers with a mouth having a different diameter, it will be sufficient to replace the tubular elements (T1, T2) with other tubular elements having an appropriate circular section, i.e. corresponding to the diameter of the mouth of the new containers.

Figures from 5 to 9 illustrate a further possible embodiment of the device (D) of the invention, particularly advantageous in cases in which the mouth of the containers (C) exhibits a very small diameter.

In these cases the cylindrical tubular elements should exhibit a circular transversal section also small and narrow, and corresponding to the diameter of the mouth of the containers, and consequently the step of transferring the pharmaceutical articles present in the tubular elements internally of the containers can be delicate, especially if the dimensions and shape of the pharmaceutical articles (tablets, capsules etc.) are unfavorable.

In these cases the tablets or capsules unloaded from the counting machine in the very narrow cylindrical tubular elements might encounter difficulty, once the end of the plate has been passed beyond, to fall with no obstructions into the containers, as it is not impossible that internally of the tubular elements there might form groupings between tablets, preventing the fall of the overlying ones.

Thus, in these cases, as clearly illustrated in figures from 5 to 9, the device (D) can be advantageously provided with tubular elements (T1, T2) both of the first series and the second series, having a transversal section of greater dimensions that the largest diameter of the mouths of the possible containers to be filled, for example preferably but not exclusively in the shape of a polygon, in particular square, as illustrated in figures from 5 to 8, or rectangular.

In this way, the tubular elements (T1, T2) can receive the counter (MC), and unproblematically store internally thereof the articles which must then be transferred to the containers, independently of the shape and dimensions of the articles, with no problems of any formations of agglomerates which might create an obstacle to the descent of the articles in the containers.

In this embodiment, the device (D) will be provided, for each of the tubular elements of the first series of tubular elements (T1) and for each of the tubular elements of the second series of tubular elements (T2), of a respective transfer element (T10, T20) of articles which is borne by the corresponding support arm (11, 21) in a lower position than the respective tubular element (T1, T2) and coaxial thereto.

Each article transfer element (T10, T20) of the article transfer elements (T10, T20) associated to the tubular elements (T1, T2) is internally hollow and provided with both an inlet opening, in the relative upper end, for receiving articles from the overlying tubular element (T1, T2), and an outlet opening in the relative lower end, for unloading articles into the containers.

In particular, the inlet opening in the upper end exhibits a perimeter or border having a shape corresponding to, and a transversal section at least equal to, the transversal section shape of the respective overlying tubular element (T1, T2).

For example, in the figures of the drawings, the tubular elements (T1, T2) exhibit a square transversal section, and consequently the inlet opening in the upper end of the article transfer element (T10, T20) will also has a square-shaped border corresponding to the border of the respective tubular element (T1, T2).

Further, each article transfer element (T10, T20) is conformed in such a way that the relative internal walls have a shape and an extension that converge towards the outlet opening in the lower end, such that the relative internal volume decreases from the upper end to the lower end, like a sort of funnel.

Lastly, each article transfer element (T10, T20) exhibits the outlet opening, in the relative lower end, having a circular transversal section and a diameter corresponding to the diameter of the mouth of the containers (C) to be filled, and this circular outlet opening will be in a position such that when the support arm (11, 21) brings the tubular element (T1, T2) and the relative article transfer element (T10, T20) to the start of the straight tract (V1), it will be situated above and centered on the mouth of the containers (C) advancing along the straight tract (V1).

As mentioned, each tubular element (T1, T2) and the relative article transfer element (T10, T20) are borne by a corresponding support arm (11, 21) in such a way as to be superposed one on another, and coaxial to one another: and further in such a way that when the support arm (11, 21) carries the tubular element (T1, T2) and the relative underlying article transfer element (T10, T20) at the start of the straight tract (V1), the lower end of the article transfer element (T10, T20) is at a slightly higher level with respect to the mouth of the containers which advance along the straight tract (V1), and with the relative opening centered with the mouth.

Further, the tubular element (T1, T2) and the relative article transfer element (T10, T20) are borne by the support arm (11, 21) such that, between the lower end of the tubular element (T1, T2) and the upper end of the transfer element (T10, T20), a space (T) is afforded, or a distance of a dimension of at least equal to or slightly larger than the thickness of the above-mentioned curved support plate (8), and the plate (8) is mounted such as to be positioned at a height at which it is interposed between the tubular element (T1, T2) and the relative underlying article transfer element (T10, T20) to occupy the space (T) when the tubular element (T1, T2) must complete the pathway thereof from the position below the outlet (U) of the counting machine (MC) up to the straight tract (V1).

In this way, the articles released by the counting machine (MC) can be received and housed freely internally of each tubular element (T1, T2), when it is positioned in the position (P1) below the outlet (U) of the counter (MC), which is interposed between the lower end and the upper end of the relative underlying article transfer element (T10, T20) for all of the movement pathway up to the start of the straight tract (V1).

The plate (8) advantageously exhibits, at the start of the above-mentioned straight tract (V1), an arched edge (81) having an extension converging towards the other edge of the plate (8), in such a way as to cause the width of the plate (8) to narrow at the length of the straight tract (V1) of advancement of the containers, along which tract the transfer of the articles to inside the containers is to be performed.

In this way, when each tubular element (T1, T2) moves and advances along the straight tract (V1), the lower end of each tubular element (T1, T2) will gradually open and the articles present therein can fall gradually internally of the relative underlying article transfer element (T10, T20) through the relative inlet opening and, thanks to the funnel-type conformation of the internal volume thereof, be conveyed progressively towards the outlet opening.

With these special details, the onset of any agglomerations of articles internally of the tubular elements is prevented, as they exhibit a greater section and not limited by the effective diameter of the mouth of the containers; a gradual passage of the articles of the tubular elements to the transfer elements is obtained, and thanks to the funnel conformation thereof a consequent progressive directing of the articles towards the outlet opening, and consequently a correct filling of the containers.

Further, in a case of a format change of the containers, there will be no need to proceed necessarily to the replacement of all the tubular elements (T1, T2) but possibly only of the article transfer elements (T10, T20) with others having the outlet opening with a circular transversal section corresponding to the diameter of the mouth of the containers to be filled.

The device (D), in both the possible embodiments described above with reference to the shape of the tubular elements, is provided with a first actuator group (5) for activating first support organ (1) in rotation the about the common rotation axis (A) and a second actuator group (6) for activating the second support organ (2) in rotation about the rotation axis (A).

The first actuator group (5) comprises a cylindrical sleeve (51) coupled to the first support organ (1), a brushless motor (52), a shaft (53) commandable in rotation by means of the brushless motor (52) and rotation transmission organs (54) mounted on the sleeve (51) and on the shaft (53), coupled to one another such as to transmit the rotation from the shaft (53) to the cylindrical sleeve (51) such as to activate in rotation the first support organ (1) (see FIG. 5).

The second actuator group (6) comprises a cylindrical sleeve (61) coupled to the second support organ (2) and mounted such as to be coaxial to and external of the cylindrical sleeve (51) coupled to the first support organ (1), a brushless motor (62), a shaft (63) commandable in rotation by means of the brushless motor (62), and rotation transmission organs (64) being mounted on the sleeve (61) and on the shaft (63), coupled to one another, such as to transmit the rotation from the shaft (63) to the cylindrical sleeve (61) such as to activate the second support organ (2) in rotation (see FIG. 5 once more).

The device (D) is further provided with a fixed cylindrical element (7), for supporting the fixed element (15), which is mounted in such a way as to be coaxial and interposed between the cylindrical sleeve (51) coupled to the first support organ (1) and the cylindrical sleeve (61) coupled to the second support organ (2), and in that it is coupled to the fixed element (15).

The brushless motor (52) of the first actuator group (5) is specially programmed to activate in rotation, via the shaft (53) and the transmission organs (54), the cylindrical sleeve (51) such as to set in rotation the first support organ (1), and thus the tubular elements (T1) of the first series of tubular elements according to the above-cited stepped and continuous modes of rotation.

In particular, the brushless motor (52) will be specially programmed as a function also of the advancement velocity of the containers (C) along the advancement direction (V) such that each of the tubular elements (T1), once all the tubular elements have been filled with the counted articles coming from the counter (MC), can reach a corresponding container and follow it, staying aligned above it for the straight tract (V1) such as to be able to carry out the transfer of the articles internally of the container (C).

The same considerations are true for and are applied also to the brushless motor (62) of the second actuator group (6).

The counter machines usually include, downstream of the detecting means of the integrity of the articles and the counter, a series of storage conduits of the articles validated as whole and counted.

Once the number of whole articles required has been accumulated internally of a storage conduit, the storage conduit unloads the articles towards the storage zone (Z) of the counter.

In the storage zone (Z) there are compartments for receiving the articles from the storage conduits, which each terminate at the outlet (U).

Figure 10:
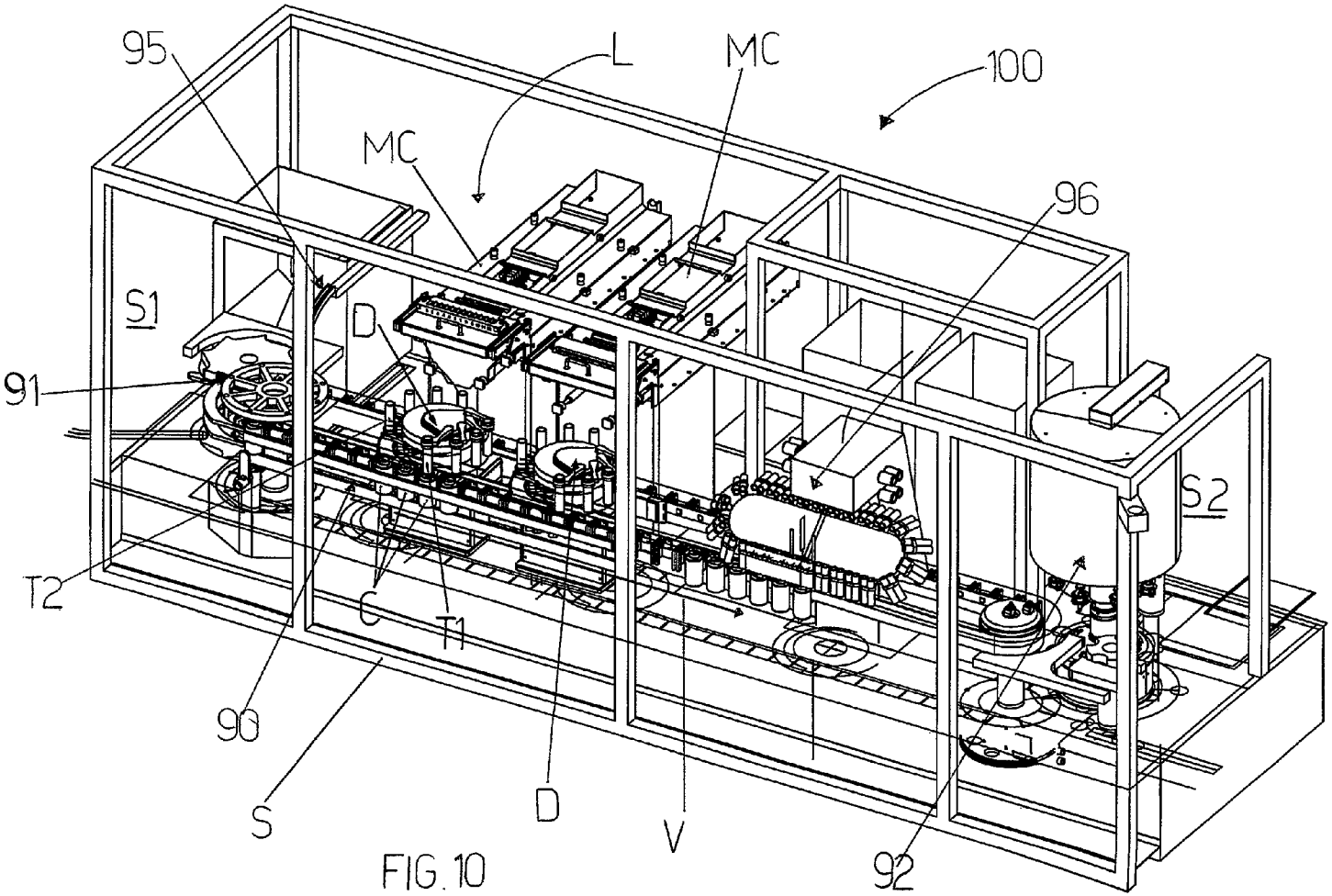
FIG. 10 is a schematic view in a perspective view of the machine for packing pharmaceutical articles in relative containers of the present invention, in which at least a device for transfer of pharmaceutical articles is predisposed, illustrated in previous figures from 1 to 9.

FIG. 10 illustrates a machine (100) for packing pharmaceutical articles in relative containers, included in the present invention.

The machine comprises a structure (S) defining internally thereof a single work environment (L) in aseptic conditions, and comprising, internally of the single work environment (L), conveyor means (90) for continuously conveying containers (C) along an advancement direction (V) which develops internally of the structure (S) from a first end (S1) to a second end (S1) of the structure (S), loading means (91) of the empty containers, situated internally of the structure (S) at the first end (S1), in order to receive from outside the empty containers one after another and transfer them one after another to the conveyor means (90), at least a counting apparatus (MC), situated in a lateral position to the conveyor means (90) at an elevated level with respect to the container (C) advancing continuously along the advancement direction (V), able to contain a mass of pharmaceutical articles, separating them one from another, verifying the integrity thereof and counting them, the counter (MC) being provided with a storage zone (Z), into which the articles are directed once counted and validated as whole, which storage zone (Z) is provided with an outlet (U) for the articles, openable for release of the articles in a downwards direction, a device (92) for capping the containers (C) that is situated in proximity of the second end (S2) of the structure (S) such as to receive, from the conveyor means (90), the containers one by one once filled, capping them and transferring them, once closed with a cap, towards an outlet conveyor (93) of the capped containers from the structure (S).

The machine (100) further advantageously comprises at least a transfer device (D) of the articles, in one or the other possible embodiment as described above, which is positioned downstream of the loading means (91) of the empty containers and in a position, between the counter (MC) and the conveyor means (90), in such a way that the tubular elements (T1) of the first series of tubular elements and the tubular elements (T2) of the second series of tubular elements are arranged vertically and in such a way that the respective upper ends are situated at a lower level than the outlet level (U) of the counter (MC) and the respective lower ends are situated at a higher level than the level of the mouth of the container (C) conveyed continuously along the advancement direction (V) and such that during the movement thereof along the rotation pathway they can transit below the outlet (U) and above the containers for a straight tract (V1) along the advancement direction (V).

The machine (100) exhibits a single structure (S) and a sole working environment (L) and is able to receive from outside, at a first end (S1) of the structure (S), empty containers and supply at the outlet of the second end (S2) of the structure (S), filled containers with the exact number of whole articles requested, and already closed.

The machine (100) enables carrying out the packing of pharmaceutical articles in relatively containers with a single compact and single-block structure.

Further, thanks to the presence of the above-cited and described device (D), the machine (100) can have conveying means (90) for continuously advancing the containers and thus guarantee a high packing productivity per minute of the pharmaceutical articles in the containers, i.e. supply in outlet a number of filled containers, and capped, decidedly higher than that of machines of known type.

With the aim of increasing productivity, the machine (100), as for example illustrated in FIG. 10, can comprise two counter apparatus (MC) flanked to one another such as two devices (D) for transferring the pharmaceutical articles from the counters to the containers, one for each of the two counters (MC).

In this case, the two transfer devices will be coordinated to one another so as to alternate in transferring the articles internally of the respective containers.

For example the first device will transfer the articles in the containers in an odd number in advancement along the direction (V) while the second device will transfer the articles into the containers of an even number, or vice versa.

The machine (100) can be predisposed, according to packing needs and type of pharmaceutical articles, such as to comprise an inserting device (95) of an anti-damp element (for example silica-gel in sachets or the like) internally of the containers (C), which is situated laterally to the conveyor means (90) and in a position between the load means (91) of the containers and the counter (MC), able to insert an anti-damp element in each of the empty containers.

In the same way, once more on the basis of the packing requirements and the type of pharmaceutical articles, the machine (100) can be predisposed to comprise an inserting device (96) of a cotton wool wad internally of the containers (C) situated laterally to the conveyor means (90) in a position between the transfer device (D) of the articles from the counter (MC) to the container (C) and the capping device (92), able to cut a cotton wad from a mass of cotton wool and insert it into the containers filled with the pharmaceutical articles during the continuous advancement thereof towards the capping device (92).

The presence of the cotton wad can be useful for maintaining the pharmaceutical articles more still internally of the containers, preventing the onset of reciprocal impacting.

The above has been described by way of non-limiting example, and any constructional variants are understood to fall within the scope of the following claims.

The invention claimed is:

1. A device for transferring pharmaceutical articles from a counter to inside continuously advancing containers, the counter exhibiting a storage zone, into which the articles are directed once counted and validated as whole, which storage zone is provided with an outlet for the articles, openable for release of the articles in a downwards direction, and which outlet is arranged laterally and in a position at an elevated level with respect to the containers advancing continuously along an advancement direction, the device wherein it comprises: a first series of tubular elements having dimensions such as to be able to freely receive the pharmaceutical articles internally thereof, and a second series of tubular elements having dimensions such as to be able to freely receive the pharmaceutical articles internally thereof, the tubular elements of the first series and the tubular elements of the second series being predisposed in such a way as to be arranged vertically so that respective upper ends thereof are situated at a lower level than the outlet level of the counter and respective lower ends thereof are situated at a higher level than the mouths of the containers continuously advancing along the advancement direction, the first series of tubular elements and the second series of tubular elements being movable independently of one another in rotation about a common rotation axis with a same rotation direction according to respective pathways that each exhibit a development such that each of the tubular elements of the first series of tubular elements can transit below and at the outlet of the counter and can also transit above the mouth of a respective container advancing continuously along the advancement direction and follow the advancement of the container while remaining above the relative mouth for a straight tract along the direction, and such that each of the tubular elements of the second series of tubular elements can transit below and at the outlet of the counter and further can transit above the mouth of a respective container advancing continuously along the advancement direction and follow the advancement of the container while remaining above the relative mouth thereof for a straight tract along the direction, wherein the first series of tubular elements is movable in rotation about the rotation axis with a stepped rotation mode such that for each stepped motion a relative tubular element can be positioned time by time paused in a position below the outlet of the counter such as to be able to receive the pharmaceutical articles counted by the counter, and further is movable, once all the tubular elements have received the corresponding number of counted articles, in rotation about the rotation axis with a continuous mode with a rotation velocity such that each of the tubular elements with the counted articles internally thereof can reach and be positioned in a position above the mouth of a corresponding container advancing along the advancement direction and follow the container with a same advancement velocity along the straight tract such as to be able to release the articles internally thereof; wherein the second series of tubular elements is movable in rotation about the rotation axis with a stepped rotation mode such that for each stepped motion a relative tubular element can be positioned time by time paused in a position below the outlet of the counter such as to be able to receive the pharmaceutical articles counted by the counter, and further is movable, once all the tubular elements have received the corresponding number of counted articles, in rotation about the rotation axis with, a continuous mode with a rotation velocity such that each of the tubular elements with the counted articles internally thereof can reach and be positioned in a position above the mouth of a corresponding container advancing along the advancement direction and follow the container with a same advancement velocity along the straight tract such as to be able to release the articles internally thereof, and wherein when the first series of tubular elements is movable in rotation in the stepped mode, such that the relative tubular elements can receive time by time the articles counted by the counter, the second series of tubular elements is moved in rotation with the continuous mode such that the relative tubular elements can unload the articles into the containers, and vice versa, and wherein it comprises a support plate which exhibits a curved development and an extension corresponding to the pathway followed by the tubular elements from the outlet of the counter up to the start of the above-cited straight tract and which is arranged in such a way as to be positioned at such a level that the lower ends of the tubular elements, once the articles have been received from the outlet of the counter, when moved along the relative tracts of pathway from the outlet of the counter up to above the containers, can slide in contact with the plate such that the articles present therein are retained internally thereof up to when the tubular elements have reached and are positioned above the mouth of the containers at the start of the straight tract, further comprising a first support organ for the first series of tubular elements and a second support organ for the second series of tubular elements, the tubular elements of the first series being borne by respective support arms each of which is pivoted to the first support organ in such a way as to be able to rotate with respect thereto about a vertical axis and in such a way as to maintain the tubular elements in a vertical position, and the tubular elements of the second series being borne by respective support arms each of which is pivoted to the second support organ such as to be able to rotate with respect thereto about a vertical axis and such as to maintain the tubular elements in a vertical position, the first support organ and the second support organ being arranged reciprocally coaxially and being rotatable about the common rotation axis and activatable in rotation with respect to the rotation axis independently of one another according to the stepped and continuous activating modes, further comprising first correcting means of the position of the support arms of the tubular elements of the first series of tubular elements with respect to the first support organ, which are configured and predisposed with respect to the first support organ in such a way that consequently to the activation in rotation of the first support organ about the rotation axis, each of the tubular elements of the first series of tubular elements, during advancement along the rotation pathway thereof about the rotation axis, can be positioned in the position below and at the outlet of the counter and further can be positioned in the position above the mouth of a respective container advancing continuously along the advancement direction and follow the advancement of the container while remaining above the relative mouth for the straight tract along the direction, and wherein it comprises second correcting means of the position of the support arms of the tubular elements of the second series of tubular elements with respect to the second support organ, which are configured and predisposed with respect to the second support organ such that consequently to the activating in rotation of the second support organ about the rotation axis, each of the tubular elements of the second series of tubular elements, during the advancement along the rotation pathway about the rotation axis, can be positioned in the position below and at the outlet of the counter and further can be positioned in the position above the mouth of a respective container in continuous advancement along the advancement direction and follow the advancement of the container remaining above the relative mouth for the straight tract along the direction, further comprising a fixed element which is mounted such as to be positioned interposed between the first support organ and the second support organ, and wherein the first correcting means of the position of the support arms of the tubular elements of the first series of tubular elements comprise a groove present in the part of the fixed element facing towards the first support organ, the groove extending in a closed loop and defining a first cam pathway, and comprising, for each of the support arms, a wheel situated internally of the groove and having such a shape as to be able to run therein and follow the route of the first cam pathway, and a rocker arm mounted at an end thereof on the wheel and fixed at the other end rigidly to the support arm, and wherein the second correcting means of the position of the support arms of the tubular elements of the second series of tubular elements comprise a groove present in the part of the fixed element facing towards the second support organ, the groove extending in a closed loop and defining a second cam pathway, and comprising, for each of the support arms, a wheel situated internally of the groove and having such a shape as to be able to run therein and follow the route of the second cam pathway, and a rocker arm mounted at an end thereof on the wheel and fixed at the other end rigidly to the support arm, and wherein the progress of the first cam pathway is such that each of the tubular elements of the first series, during the advancement along the rotation pathway about the rotation axis, can be positioned in the position below and at the outlet of the counter and can be positioned in the position above the mouth of a container advancing along the advancement direction and follow it remaining aligned to the mouth for the straight tract of advancement along the advancement direction, and wherein the progress of the second cam pathway is such that each of the tubular elements of the second series, during the advancement along the rotation pathway about the rotation axis, can be positioned in the position below and at the outlet of the counter and can be positioned in the position above the mouth of a container advancing along the advancement direction and follow it while remaining aligned to the mouth for the straight tract of advancement along the advancement direction, wherein each tubular element of the first series of tubular elements and each tubular element of the second series of tubular elements has such a shape as to exhibit a transversal section having larger dimensions than the diameter of the mouth of the containers, and wherein it comprises, for each tubular element of the first series of tubular elements, and for each tubular element of the second series of tubular elements, a respective article transfer element which is borne by the support arm of the tubular element in a lower position and coaxial to the relative tubular element such as to be one superposed on the other and in such a way that between them a space is afforded having dimensions at least equal to the thickness of the rest plate, wherein the rest plate is predisposed and mounted such as to be positioned at a height such that it is interposed to occupy the space between the tubular element and the relative underlying article transfer element when the tubular element completes the movement pathway thereof from the position below the outlet of the counting machine up to a position above the start of the straight tract, such that the articles received from the tubular element are retained therein resting on the plate during the movement thereof up to the start of the straight tract, and wherein each article transfer element is internally hollow and provided with an inlet opening, in the relative upper end, having a transversal section at least equal to the transversal section of the transversal section of the relative overlying tubular element and an opening outlet in the relative lower end, having a circular transversal section and having a diameter corresponding to the diameter of the mouth of the containers, and wherein each article transfer element is conformed such that the relative internal walls are of a shape and an extension that converge towards the outlet opening such that the relative internal volume decreases from the upper end to the lower end in a funnel fashion.

2. The device of claim 1, wherein each tubular element and the relative underlying article transfer element are borne by the corresponding relative support arm such that when the support arm following the rotation of the relative support organ bears the tubular element and the relative underlying article transfer element at the start of the straight tract, the lower end of the article transfer element is at a slightly more elevated height with respect to the mouth of the containers which advance along the straight tract, and with the relative outlet opening centered with the mouth.

3. The device of claim 2, wherein the rest plate exhibits, at the start of the straight tract, an arched edge having a converging extension towards the other edge of the plate, such as to decrease the width of the plate at the length of the straight tract of advancement of the containers, along which straight tact the transfer of the articles into the containers is to occur, in such a way that when each tubular element runs and advances along the straight tract, the lower end of each tubular element will be opened gradually by the progressive narrowing of the plate and the articles present therein can fall gradually internally of the relative underlying article transfer element through the relative inlet opening and, thanks to the funnel conformation of the internal volume thereof, be conveyed progressively towards the outlet opening and fall into the container.

4. The device of claim 1, wherein each tubular element of the first and the second series of tubular elements exhibits a polygonal transversal section, in particular square.

* * * * *